US010033092B2

(12) United States Patent
Vanjani et al.

(10) Patent No.: US 10,033,092 B2
(45) Date of Patent: Jul. 24, 2018

(54) APPARATUS AND METHOD FOR UTILIZING A COMPONENT WITH A HELICAL ANTENNA FOR COMMUNICATING RF SIGNALS

(71) Applicant: Futurewei Technologies, Inc., Plano, TX (US)

(72) Inventors: Kiran Vanjani, San Diego, CA (US); Hongwei Liu, San Diego, CA (US)

(73) Assignee: FUTUREWEI TECHNOLOGIES, INC., Plano, TX (US)

( * ) Notice: Subject to any disclaimer, the term of this patent is extended or adjusted under 35 U.S.C. 154(b) by 155 days.

(21) Appl. No.: 14/806,548

(22) Filed: Jul. 22, 2015

(65) Prior Publication Data

US 2017/0025747 A1 Jan. 26, 2017

(51) Int. Cl.

| | |
|---|---|
| ***H01Q 1/36*** | (2006.01) |
| ***H01Q 1/27*** | (2006.01) |
| ***H01Q 1/44*** | (2006.01) |
| *H01Q 11/08* | (2006.01) |

(52) U.S. Cl.

CPC ..... *H01Q 1/362* (2013.01); *H01Q 1/273* (2013.01); *H01Q 1/44* (2013.01); *H01Q 11/08* (2013.01)

(58) Field of Classification Search

CPC ..... H01Q 1/273; H01Q 1/276; H01Q 1/362; H01Q 11/08; H01Q 11/083; H01Q 11/086; G04R 60/10; G04R 60/12; G06F 1/163; G06F 3/014; A44C 5/0007

USPC ..... 343/702, 796, 895; 361/679.03

See application file for complete search history.

(56) References Cited

U.S. PATENT DOCUMENTS

| | | | | | |
|---|---|---|---|---|---|
| 4,120,148 | A * | 10/1978 | Moyer | G04G 5/00 | 368/204 |
| 5,172,348 | A * | 12/1992 | Paratte | G04B 47/025 | 368/47 |
| 5,479,178 | A * | 12/1995 | Ha | H01Q 1/244 | 343/702 |
| 6,008,765 | A * | 12/1999 | Davidson | H01Q 1/244 | 343/702 |
| 6,112,102 | A * | 8/2000 | Zhinong | H01Q 1/362 | 455/552.1 |
| 6,212,414 | B1 * | 4/2001 | Alameh | H04B 1/385 | 455/347 |

(Continued)

FOREIGN PATENT DOCUMENTS

| | | |
|---|---|---|
| CN | 204314789 U | 5/2015 |
| EP | 0443491 A1 | 8/1991 |

(Continued)

OTHER PUBLICATIONS

International Search Report from International Application No. PCT/CN2016/090324, dated Oct. 21, 2016.

(Continued)

*Primary Examiner* — Hoang Nguyen
*Assistant Examiner* — Awat Salih
(74) *Attorney, Agent, or Firm* — Futurewei Technologies, Inc.

(57) ABSTRACT

An apparatus and method are provided for utilizing a component with a helical antenna for communicating radio frequency (RF) signals. Included is a housing and a component coupled to the housing. Further provided is a helical antenna coupled to the component. In use, the helical antenna serves to communicate RF signals.

22 Claims, 18 Drawing Sheets

(56) References Cited

U.S. PATENT DOCUMENTS

| | | | | |
|---|---|---|---|---|
| 6,366,247 | B1 * | 4/2002 | Sawamura | H01Q 1/244 343/702 |
| 6,411,569 | B1 * | 6/2002 | Megner | G04B 37/0008 368/10 |
| 8,620,395 | B2 * | 12/2013 | Kang | H04M 1/02 174/50 |
| 8,774,855 | B2 | 7/2014 | Sanchez et al. | |
| 8,982,063 | B2 * | 3/2015 | Ramrattan | G06F 1/169 345/157 |
| 2004/0090868 | A1 * | 5/2004 | Endo | G04G 21/04 368/10 |
| 2004/0150578 | A1 * | 8/2004 | Nomura | H01Q 1/1207 343/788 |
| 2004/0231159 | A1 * | 11/2004 | Shibuya | A44C 27/006 29/896.412 |
| 2006/0126438 | A1 * | 6/2006 | Itou | G04G 17/08 368/47 |
| 2009/0147630 | A1 * | 6/2009 | Clerc | G04B 37/106 368/290 |
| 2009/0305657 | A1 * | 12/2009 | Someya | H01Q 1/273 455/269 |
| 2010/0060540 | A1 * | 3/2010 | Abe | H01Q 7/08 343/788 |
| 2013/0307731 | A1 | 11/2013 | Vanjani et al. | |
| 2014/0078017 | A1 | 3/2014 | Vanjani et al. | |
| 2014/0132465 | A1 | 5/2014 | Sanchez et al. | |
| 2014/0134958 | A1 | 5/2014 | Sanchez et al. | |
| 2014/0135058 | A1 | 5/2014 | Sanchez et al. | |
| 2014/0187284 | A1 | 7/2014 | Sanchez et al. | |
| 2014/0213324 | A1 * | 7/2014 | Tan | H04M 1/0268 455/566 |
| 2014/0253410 | A1 * | 9/2014 | DiNallo | H01Q 1/362 343/895 |
| 2014/0266935 | A1 * | 9/2014 | Tankiewicz | H01Q 7/00 343/720 |
| 2015/0130666 | A1 * | 5/2015 | Pan | H02J 7/0045 343/702 |

FOREIGN PATENT DOCUMENTS

| | | | |
|---|---|---|---|
| EP | 1420476 | A1 | 5/2004 |
| JP | H11177328 | A | 7/1999 |

OTHER PUBLICATIONS

Fried, I., "Timex Teams With Qualcomm, AT&T for Cell-Equipped Smartwatch," re/code, Aug. 5, 2014, pp. 1-2, retrieved from http://recode.net/2014/08/05/timex-teams-up-with-qualcomm-and-att-for-cellular-equipped-smartwatch/.

"Internet of Things," 2014, pp. 1-54, retrieved from http://connected1503.rssing.com/chan-25997370/all_p7.html.

Tinari, G., "AT&T unveils FiLIP, a smartwatch for kids and parents," Oct. 8, 2013, p. 1, retrieved from http://www.neowin.net/news/att-unveils-filip-a-smartwatch-for-kids-and-parents.

"Motorola Moto 360 Teardown," iFixit, 2014, pp. 1-14, retrieved from https://www.ifixit.com/Teardown/Motorola+Moto+360+Teardown/28891.

"Qualcomm Toq Smartwatch TopSW1," TECHINSIGHTS, 2014, pp. 1-25, retrieved from http://www.techinsights.com/uploadedFiles/Public_Website/Content_-_Primary/Teardowncom/Sample_Reports/Wearable-Wellness_Survey_Sample_Report.pdf.

Fossil, "Q Founder Digital Display Two-Tone Stainless Steel Touchscreen Smartwatch," pp. 1-9, retrieved on Apr. 13, 2016 from https://www.fossil.com/us/en/wearable-technology/connected-accessories/smartwatches-display/q-founder-digital-display-two-tone-stainless-steel-touchscreen-smartwatch-sku-ftw20021p.html.

Tag Heuer, "TAG Heuer Connected," www.tagheuerconnected.com, Apr. 6, 2016, pp. 1-8.

Apple, "Apple Watch," pp. 1-6, retrieved on Apr. 13, 2016 from www.apple.com/watch/.

Painter, L., "ZTE Axon Watch review: Hands-on with a sleek and gorgeous faux Android Wear smartwatch that'll never hit the UK," PC Advisor, Mar. 3, 2016, pp. 1-3, retrieved from www.pcadvisor.co.uk/review/wearable-tech/zte-axon-watch-review-uk-availability-design-spec-software-mwc-2016-3636145/.

Technology Pep, "Rockioo Watch: A New Stand-Alone SmartWatch," pp. 1-5, retrieved on Apr. 13, 2016 from www.technologypep.com/rockioo-watch-a-new-stand-alone-smartwatch.html.

Vanjani, U.S. Application No. 15/177,273, filed Jun. 8, 2016.

* cited by examiner

1000

1100

1400

1402

1404

1500

1600

APPARATUS AND METHOD FOR UTILIZING A COMPONENT WITH A HELICAL ANTENNA FOR COMMUNICATING RF SIGNALS

FIELD OF THE INVENTION

The present invention relates to antennas, and more particularly to antennas for wearable devices.

BACKGROUND

Relatively recently, a new market segment in the form of computerized wearables has been experiencing sizeable growth. For example, "smart" watches are gaining popularity, particularly among smart phone users. Typically, the aforementioned smart watches are equipped with short-range transceivers (e.g. BLUETOOTH, Wi-Fi, etc.) for providing communication between the smart watch and the smart phone. Some of these smart watches also have global positioning system (GPS) connectivity, as well.

Thus, while such smart watches are equipped with the necessary infrastructure (e.g. circuitry, antennas, etc.) to accommodate such short-range communication, there has been a lack of long-range communication support. An example of such long-range communication includes cellular communication, for instance. While there are many challenges in incorporating cellular user equipment (UE) infrastructure into a smart watch, incorporation of a sufficient antenna poses a particular challenge. For example, it is very difficult to have cellular signals resonate in multiple bands when placed in an all-metal housing, that are typical of watches. Even in non-metallic smart watch environments, other challenges (e.g. size constraints, etc.) also exist.

There is thus a need for addressing these and/or other issues associated with the prior art.

SUMMARY

An apparatus and method are provided for utilizing a component with a helical antenna for communicating radio frequency (RF) signals. Included is a housing and a component coupled to the housing. Further provided is a helical antenna coupled to the component. In use, the helical antenna serves to communicate RF signals.

DETAILED DESCRIPTION

Figure 1:
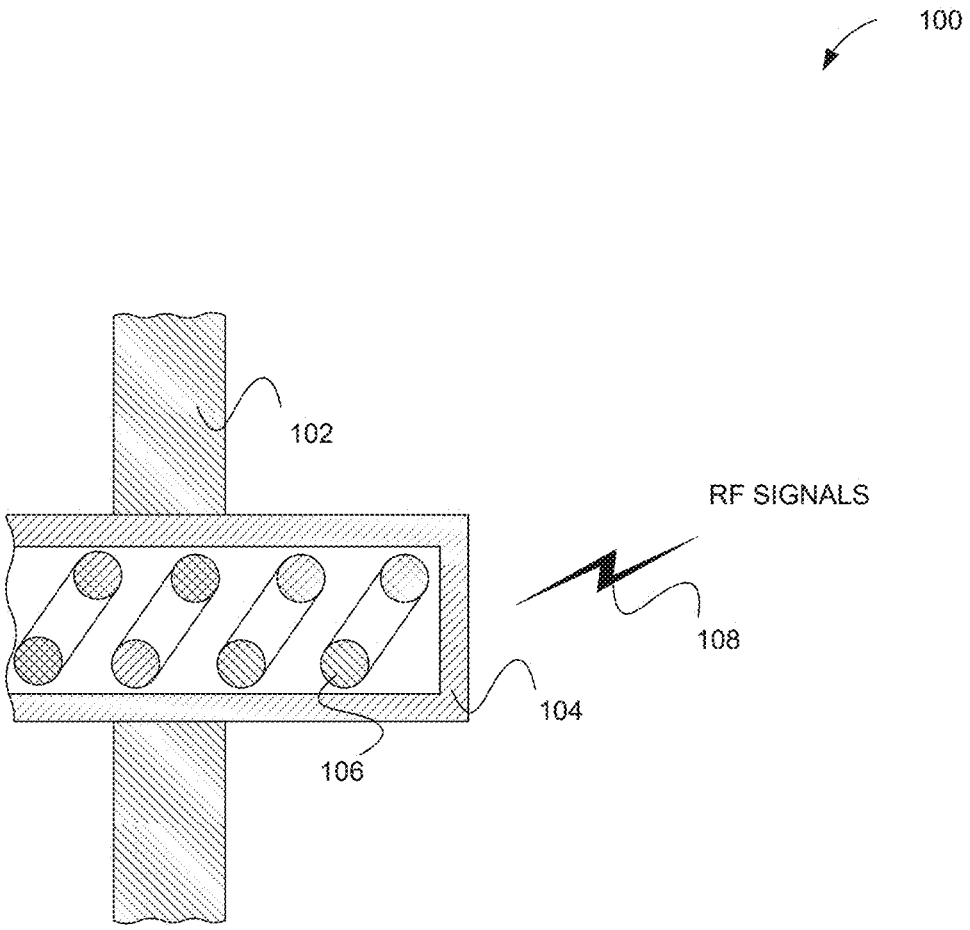
FIG. 1 illustrates an apparatus for utilizing a component with a helical antenna for communicating radio frequency (RF) signals, in accordance with one embodiment.

FIG. 1 illustrates an apparatus 100 for utilizing a component with a helical antenna for communicating radio frequency (RF) signals, in accordance with one embodiment. As shown, the apparatus 100 includes a housing 102 and a component 104 coupled to the housing. In the context of the present description, the housing 102 may include any structure that is capable of having a component 104 coupled thereto. Further, the component 104 may refer to any mechanism that functions and/or simply looks like it functions (for aesthetics) as a component for controlling a device associated with the housing 102.

For example, in one embodiment, the housing 102 may be a component of a wrist watch. Of course, other embodiments are contemplated where the housing 102 may be a component of a phone (e.g. smart phone, etc.), personal digital assistant (PDA), glasses (e.g. smart glasses, etc.), pedometer, heart rate and/or oxygen monitor, mobile electronic device, wearable article, or any other device, for that matter.

Still yet, in one possible embodiment, the component 104 may be moveably (e.g. slidably, etc.) coupled to the housing 102, as shown. For example, in one embodiment, the component 104 may be operable such that a signal is generated in response to a depression (e.g. manual depression, etc.) of the component 104. Such signal could, in various optional embodiments, control at least one aspect of a device housed by the housing 102. In such embodiment, the component 104 may optionally include a pusher. In other embodiments, the component 104 may be rotatably coupled (e.g. so as to be windable, etc.) to the housing 102, to generate a signal and/or interact with internal mechanical components (e.g. winding spring, etc.) in the housing 102. Of course, any combination of different movements may be implemented for allowing any type of manipulation, in various embodiments. Of course, as mentioned earlier, the component 104 may be configured for only aesthetic purposes (e.g. constitute a "mock," imitation, artificial, etc. pusher or other type of component).

With continuing reference to FIG. 1, a helical antenna 106 is coupled to the component for communicating radio frequency (RF) signals 108. In the context of the present description, the helical antenna 106 may refer to any antenna that is any one of the following: curved around along a straight or slightly curved axis, formed as a coil, spiral in design, or formed as a helix, at least in part. Further, the term communicate may refer to any receipt or transmission of signals. While the aforementioned RF signals 108 may, in one embodiment, include multi-band-multi-mode cellular RF signals 108 (or other longer-range signals), it should be noted that, in other embodiments, any RF signals 108 (e.g. short-range signals such as Bluetooth, Wi-Fi, near-field, etc.) may be utilized alone or in combination with each other. Further, it should be noted that the aforementioned coupling between the helical antenna 106 and the component 104 does not necessarily (but may) require the helical antenna 106 to be physically/fixedly attached to the component 104. For example, the helical antenna 106 may, in one embodiment, be sized to reside within the component 104 and, through such constrained environment, be "coupled" thereto.

In an embodiment where the component 104 is not solely cosmetic in design, the helical antenna 106 may serve a mechanical purpose, in addition to an electrical purpose. Specifically, in one embodiment, the helical antenna 106 may be configured to be springably-biased in response to the depression of the component 104 so as to extend the component 104 after the depression of the component 104 is released. Of course, as mentioned earlier, embodiments are contemplated where the component 104 is merely cosmetic and, therefore, the helical antenna 106 solely serves its antenna functions.

In one possible embodiment that is shown in FIG. 1, the helical antenna 106 may be positioned at least partially in the component 104. Further, an end of the helical antenna 106 may extend radially beyond a periphery of the housing 102. In such embodiment, the helical antenna 106 may be better situated for serving its antenna functions. To further enhance the operation of the helical antenna 106, the component 104 may be constructed from a conductive material. Of course, other embodiments are contemplated where the above conditions are not necessarily present.

More illustrative information will now be set forth regarding various optional architectures and uses in which the foregoing method may or may not be implemented, per the desires of the user. It should be strongly noted that the following information is set forth for illustrative purposes and should not be construed as limiting in any manner. Any of the following features may be optionally incorporated with or without the exclusion of other features described.

Figure 2:
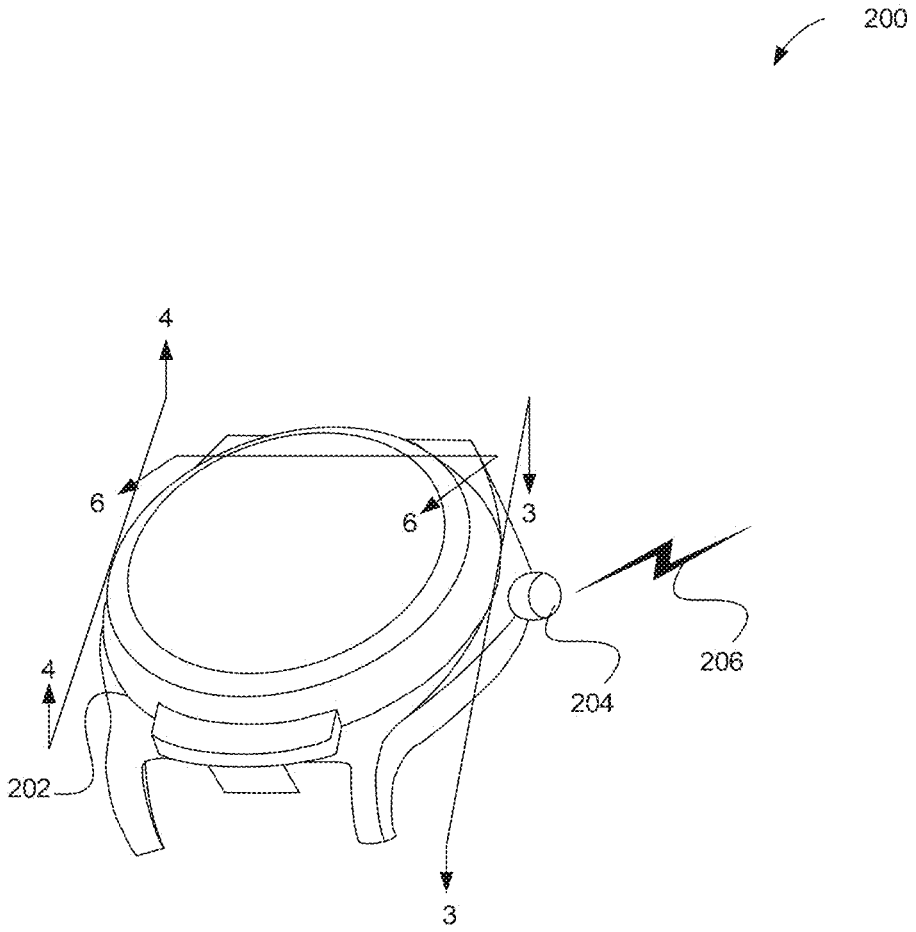
FIG. 2 is a perspective view of a watch equipped with a pusher with a helical antenna for communicating RF signals, in accordance with one embodiment.

FIG. 2 is a perspective view of a watch 200 equipped with a pusher with a helical antenna for communicating RF signals, in accordance with one embodiment. As an option, the watch 200 may be implemented in the context of any one or more of the embodiments set forth in any previous and/or subsequent figure(s) and/or description thereof. Of course, however, the watch 200 may be implemented in the context of any desired environment.

As shown, the watch 200 includes a round-faced housing 202 with at least one pusher 204 positioned on a periphery thereof. Of course, in other embodiments, the round-faced housing 202 may be substituted with a rectilinear-faced (e.g. rectangular, square, etc.) housing, or any other shape, for that matter. In use, a helical antenna (not shown) situated within the pusher 204 may serve to communicate RF signals 206.

Further, while only one pusher 204 is shown in the present embodiment, it should be noted that other embodiments are contemplated with more than one pusher 204. In embodiments where multiple pushers 204 are incorporated (each with a helical antenna), they may be similarly or differently constructed (e.g. one or more rotatable and one or more depressible, one or more operable for control purposes and one or more cosmetic, etc.). Of course, other embodiments are envisioned where one or more pushers are equipped with a helical antenna, and another one or more pushers are void of a helical antenna.

Figure 3:
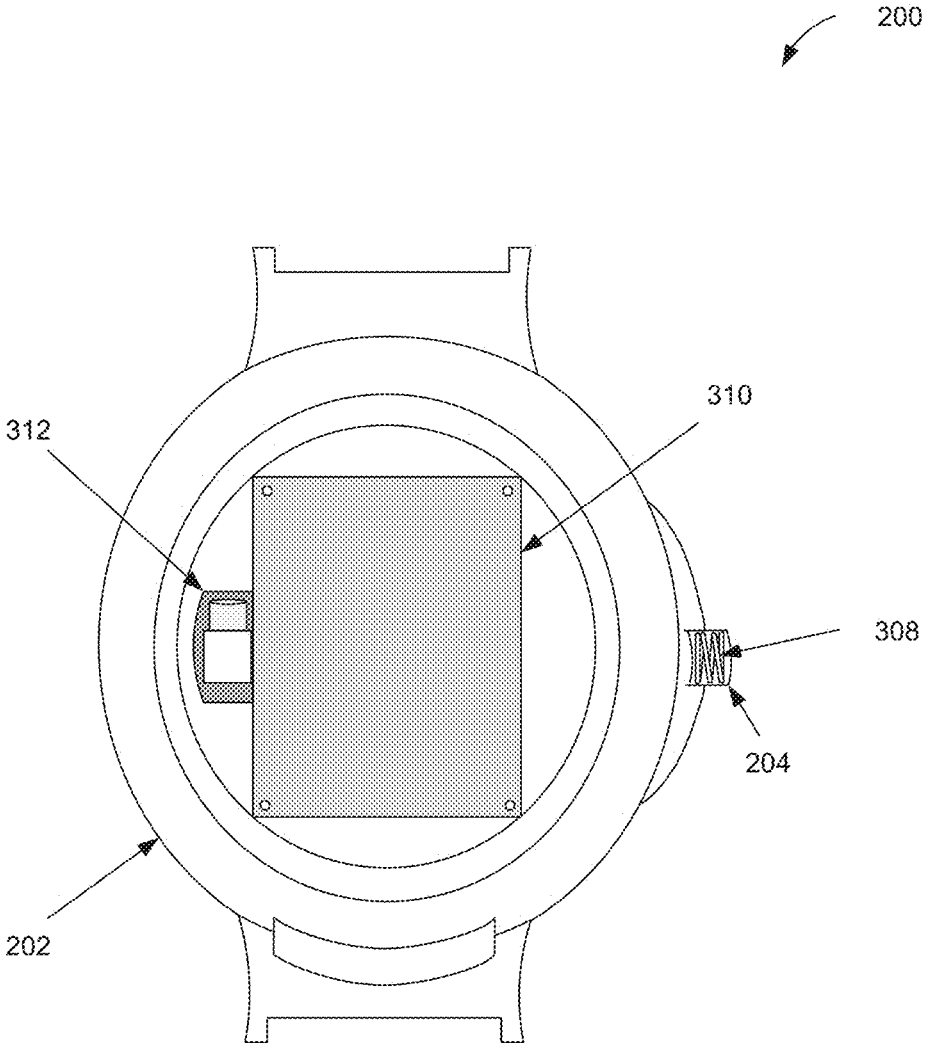
FIG. 3 is a top cross-sectional view of the watch taken along line 3-3 shown in FIG. 2, in accordance with one embodiment.

FIG. 3 is a top cross-sectional view of the watch 200 taken along line 3-3 shown in FIG. 2, in accordance with one embodiment. As illustrated, the pusher 204 is shown in phantom view for exposing a helical antenna 308 therein. Further exposed by the top cross-sectional view of FIG. 3 is a printed circuit board (PCB) 310 mounted within the housing 202, in the manner shown. Such PCB 310 is equipped with circuitry 312 mounted thereon, for providing any desired functionality in connection with use of the watch 200.

Figure 4:
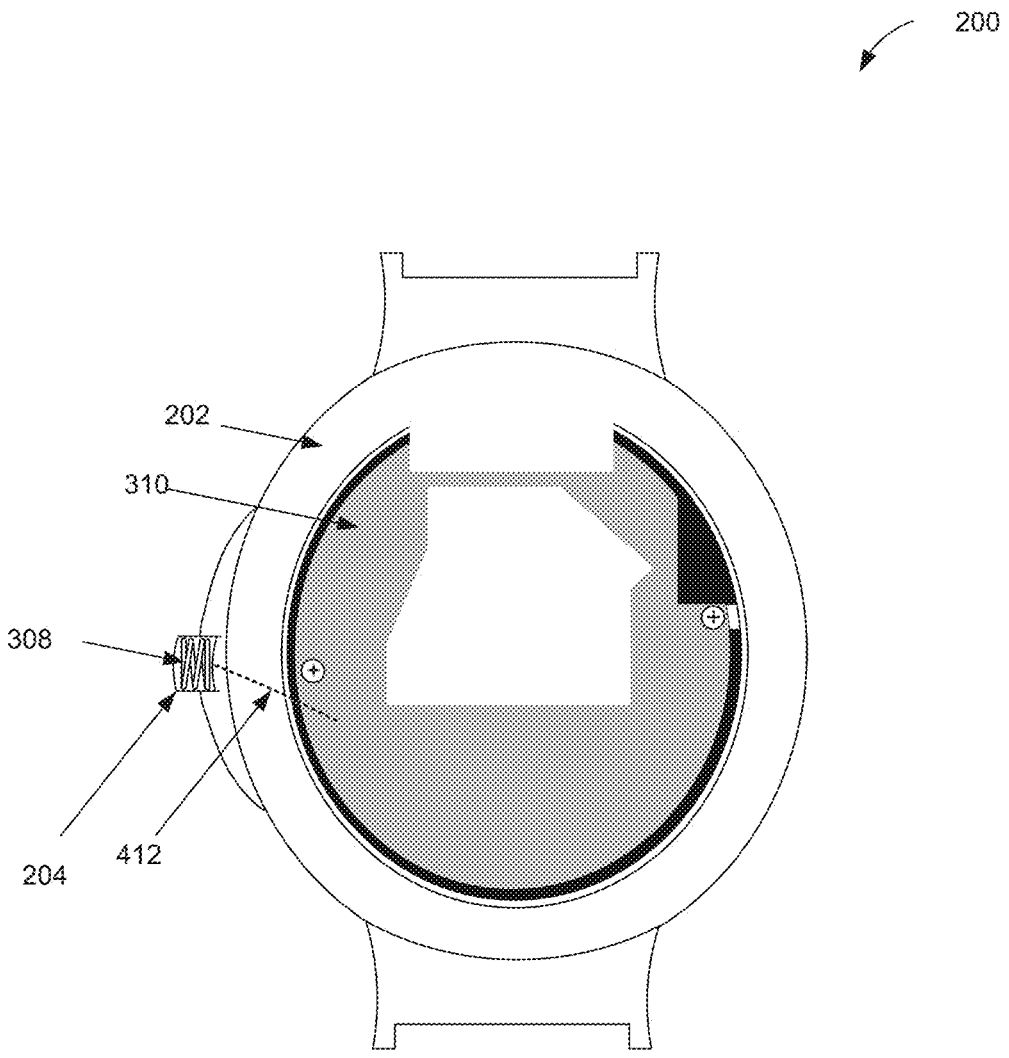
FIG. 4 is a bottom cross-sectional view of the watch taken along line 4-4 shown in FIG. 2, in accordance with one embodiment.

FIG. 4 is a bottom cross-sectional view of the watch 200 taken along line 4-4 shown in FIG. 2, in accordance with one embodiment. The pusher 204 is again shown in phantom view for exposing the helical antenna 308 therein. Further shown by the bottom cross-sectional view of FIG. 4 is an electrical connection 412 between the helical antenna 308 and the PCB 310 mounted within the housing 202.

Figure 5:
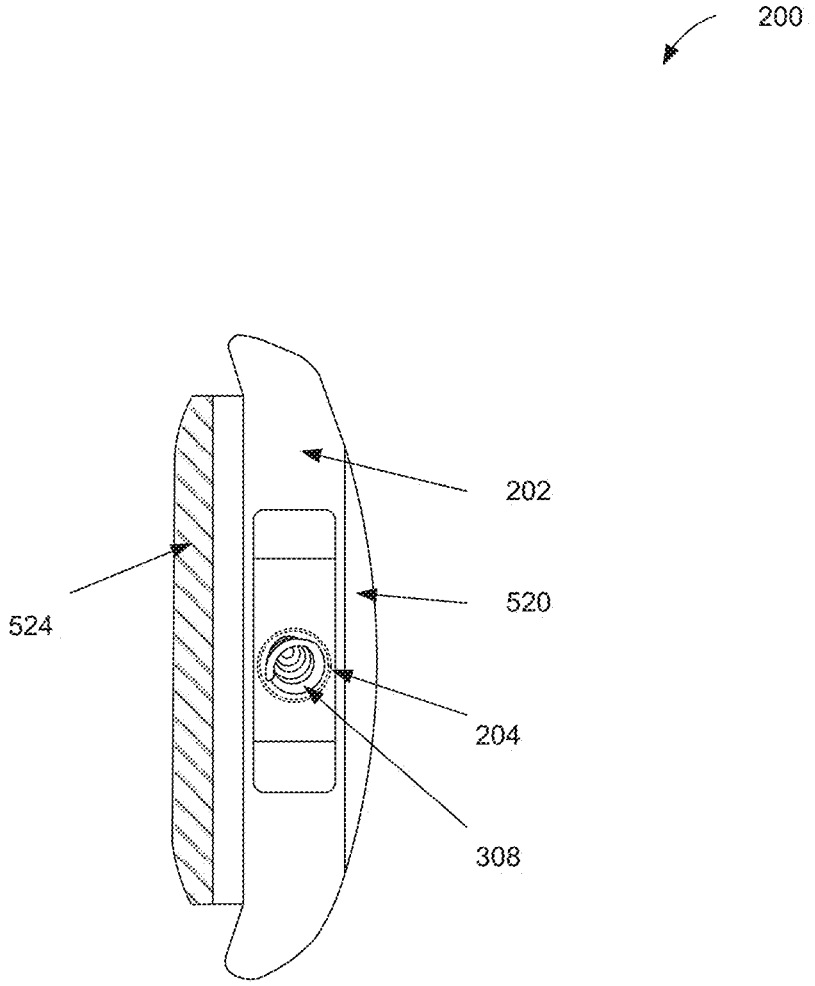
FIG. 5 is a side view of the watch shown in FIG. 2, in accordance with one embodiment.

FIG. 5 is a side view of the watch 200 shown in FIG. 2, in accordance with one embodiment. Again, the pusher 204 is shown in phantom view for exposing the helical antenna 308 therein. As further shown, the watch 200 is equipped with a front transparent facing 520 and a back plate 524 that is configured for abutting a skin of a user when the watch 200 is worn. In one embodiment, the back plate 524 of the housing 202 may be constructed from an insulative material.

Figure 6:
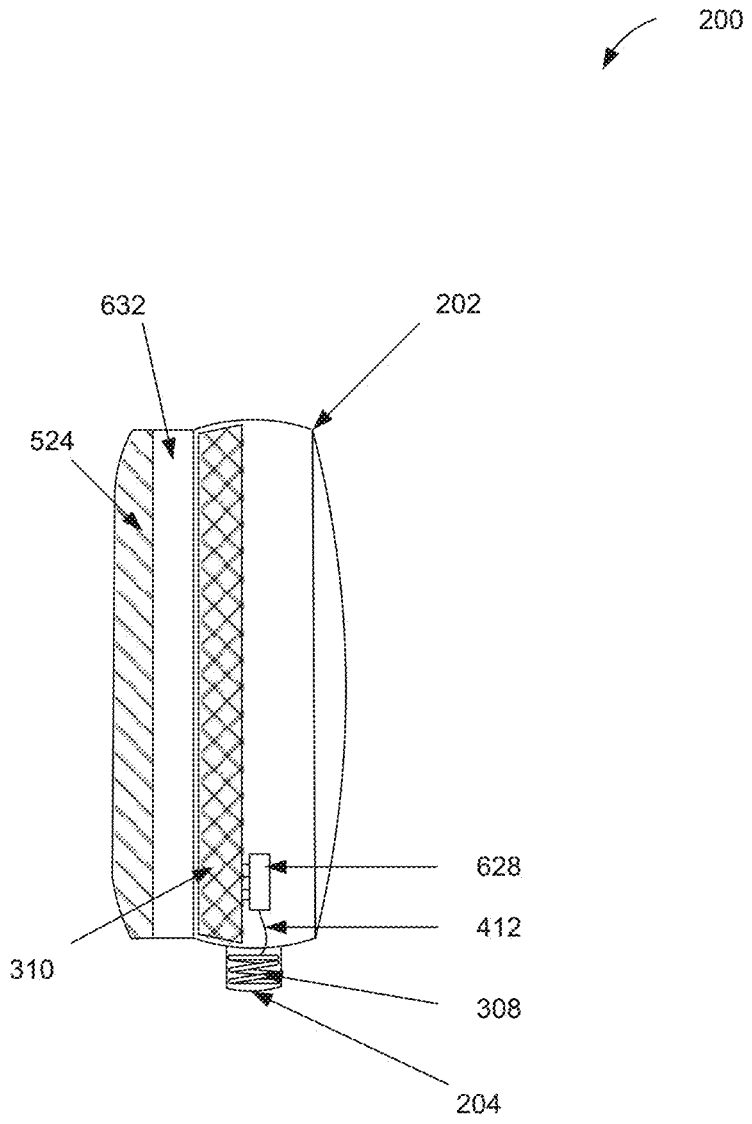
FIG. 6 is a side cross-sectional view of the watch taken along line 6-6 shown in FIG. 2, in accordance with one embodiment.

FIG. 6 is a side cross-sectional view of the watch 200 taken along line 6-6 shown in FIG. 2, in accordance with one embodiment. Yet again, the pusher 204 is shown in phantom view for exposing the helical antenna 308 and its electrical connection 412 which, in turn, is coupled to a transceiver 628 mounted on the PCB 310. While not shown, such transceiver 628 may be electrically coupled to the circuitry 312 of FIG. 3, as well as a power supply (not shown).

Also shown by the side cross-sectional view of FIG. 6 is the back plate 524 of the housing 202 that is configured for abutting the skin of the user, as set forth earlier. Further, the housing 202 is configured with an insulative region 632 between the back plate 524 and the PCB 310 with the transceiver 628 mounted thereon.

In various embodiments, the insulative region 632 may simply comprise a hermetically sealed region filled with air. Of course, in other embodiments, the insulative region 632 may be filled with a specific insulative material that is the same or different than that from which the back plate 524 of the housing 202 is constructed. In any case, the insulative region 632 and the back plate 524 of the housing 202 may cooperate in insulating the skin of the user from any radiation that may be emitted from the transceiver 628 and/or the helical antenna 308, during use.

Figure 7:
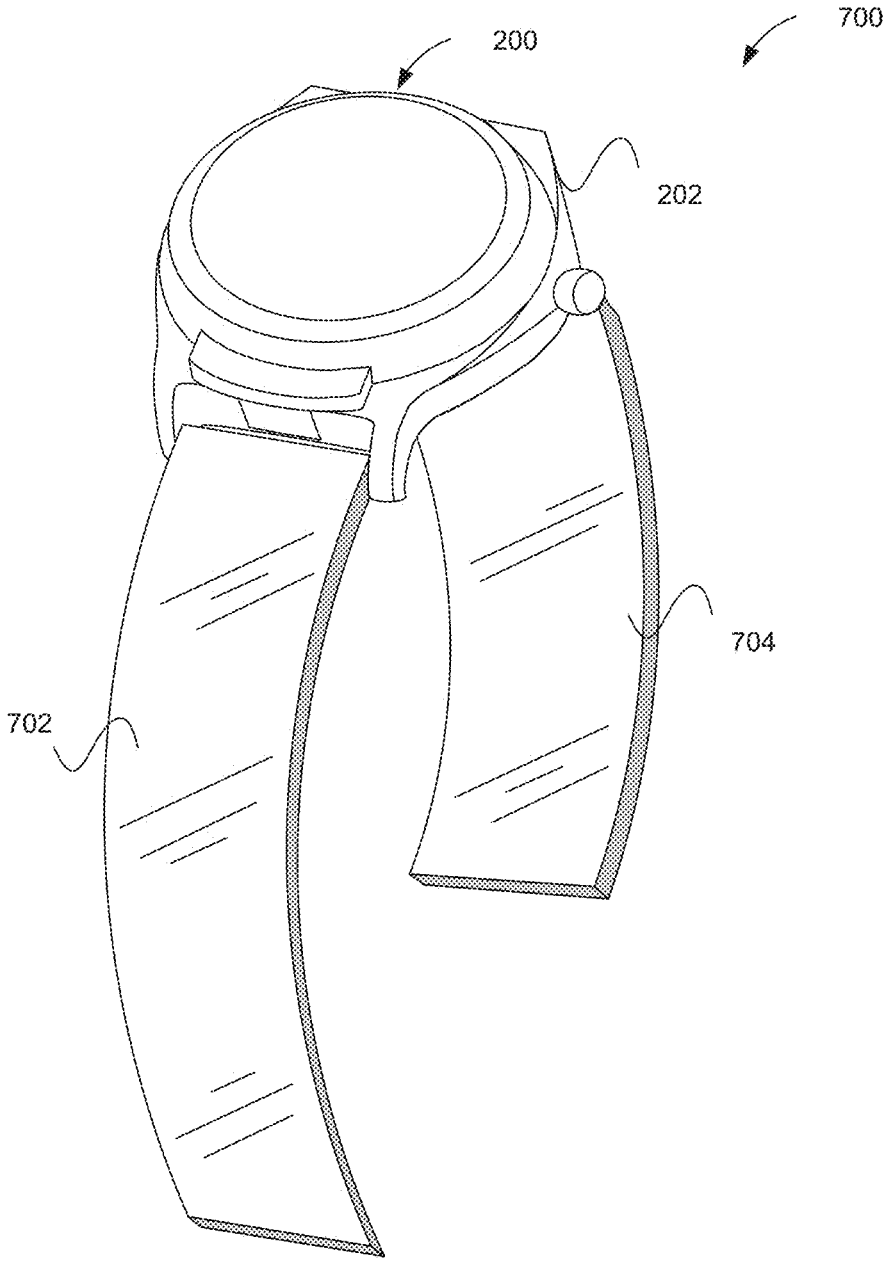
FIG. 7 is perspective view of the watch shown in FIG. 2 equipped with wrist bands, in accordance with one embodiment.
Figure 8:
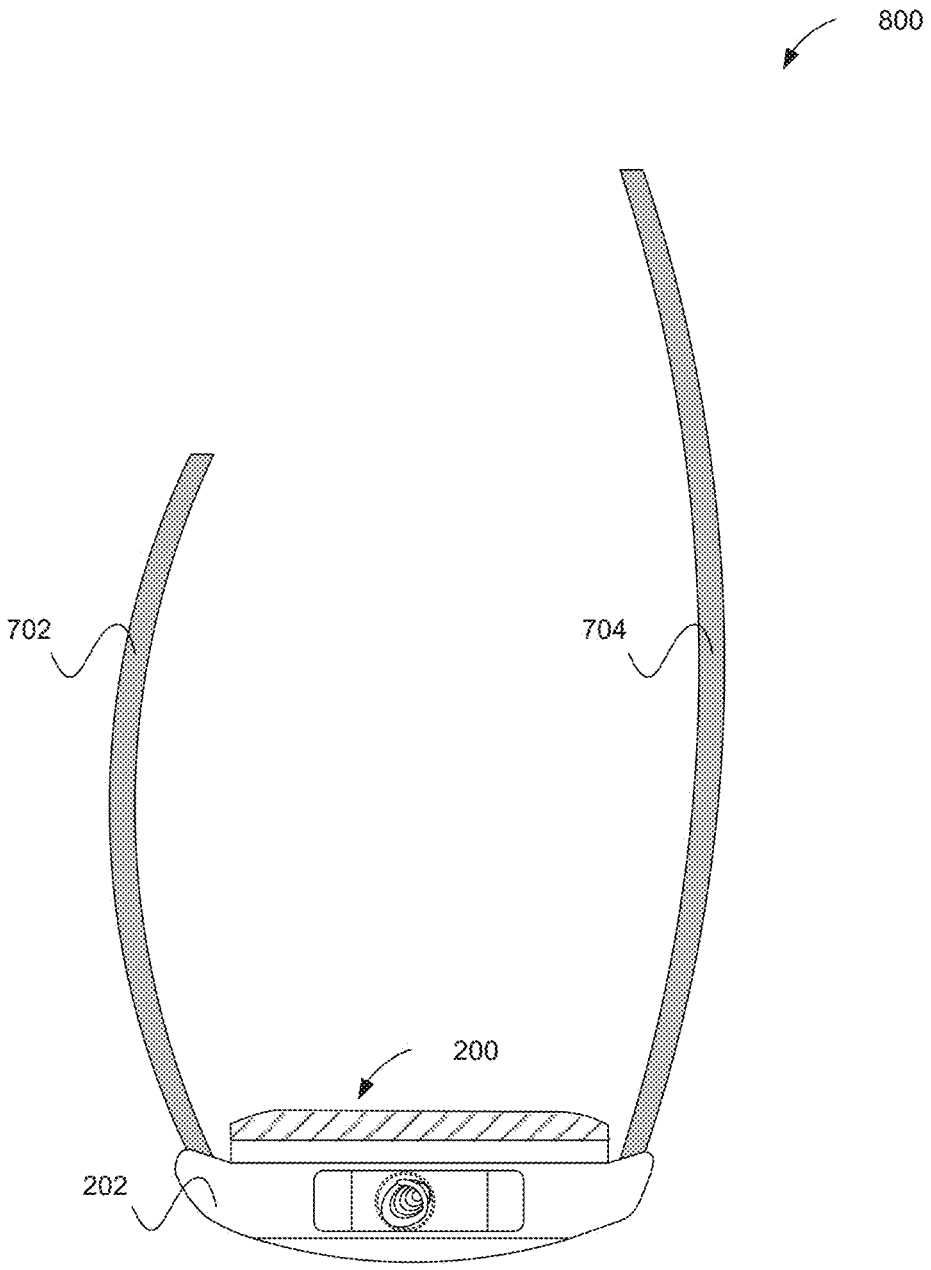
FIG. 8 is a side inverted view of the watch shown in FIG. 2 equipped with the wrist bands shown in FIG. 7, in accordance with one embodiment.

FIG. 7 is perspective view 700 of the watch 200 shown in FIG. 2 equipped with wrist bands, in accordance with one embodiment. As shown, the watch 200 of FIG. 7 is equipped with a pair of wrist bands 702, 704. In one embodiment, the wrist bands 702, 704 may be constructed from a conductive material that is in electrical communication with a printed circuit board (e.g. PCB 310 of FIGS. 3-4, etc.) positioned in the housing 202 for providing a ground plane in connection with a helical antenna (e.g. helical antenna 308 of FIGS. 3-6, etc.). In such embodiment, the wrist bands 702, 704 may help extend a reference ground plane and this may, in turn, help allow enhanced low band performance. FIG. 8 is a side inverted view 800 of the watch 200 shown in FIG. 2 equipped with the wrist bands 702, 704 shown in FIG. 7, in accordance with one embodiment.

Figure 9:
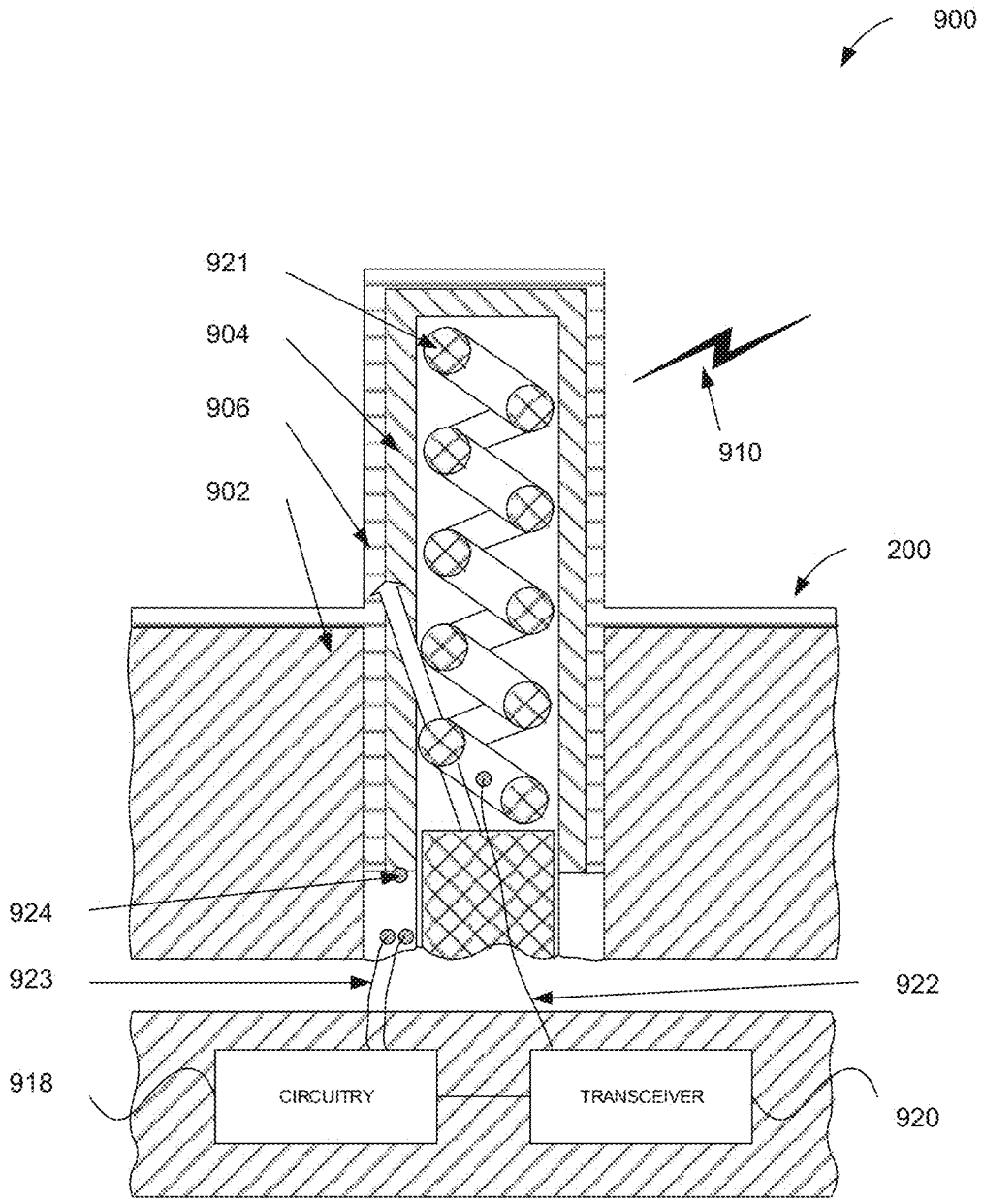
FIG. 9 is a cross-sectional view of a watch equipped with a pusher with a helical antenna for communicating RF signals, in accordance with one embodiment.

FIG. 9 is a cross-sectional view of a watch 900 equipped with a pusher with a helical antenna for communicating RF signals, in accordance with one embodiment. As an option, the watch 900 may be implemented in the context of any one or more of the embodiments set forth in any previous and/or subsequent figure(s) and/or description thereof. For example, the watch 900 may be implemented in the context of the watch 200 of FIGS. 2-8, in one embodiment. Of course, however, the watch 900 may be implemented in the context of any desired environment.

With reference to FIG. 9, the watch 900 includes a housing 902 constructed from a conductive (e.g. metal, etc.) material. Of course, other embodiments are contemplated where the watch 900 includes an insulative housing 902. Further included is a pusher 904 slidably coupled to the housing 902. In one embodiment, the pusher 904 may be constructed from a conductive material, and an outer surface of the pusher 904 may be lined with at least one material 906 that is insulative, but has a metallic appearance. As an option, in such embodiment, the at least one material 906 may be equipped with the metallic appearance to compliment an appearance of the housing 902 which may or may not be lined with the same material 906 or a different material that the material 906 is designed to complement (e.g. match, etc.). As an option, a non-conductive vacuum metallization (NCVM) process may be used to apply the material 906. This way, an external cap of the pusher 904 may be designed to help remain RF transparent and better enable signals to radiate, as will soon become apparent.

Further included is circuitry 918 for controlling the watch 900 and generating cellular signals. This is accomplished via a transceiver 920 in communication with the circuitry 918 for communicating the cellular signals. Still yet, a helical antenna 921 is situated in the pusher 904 and in communication with the transceiver 920 via first electrical connections 922 such that cellular signals 910 may be received and/or radiated therefrom. Still yet, the circuitry 918 serves to control the watch 900 by way of second electrical connections 923 connected to a switch 924 that is closed (or opened) in response to the depression of the pusher 904.

By this design, a watch constructed in accordance with one or more of the foregoing embodiments may be used to effectively transmit cellular signals, without necessarily compromising an appealing all-metal construction, in some embodiments. Further, the helical antenna may resonate in conjunction with a PCB ground plane, metal watch straps, and an all-metal watch housing body. In use, the helical antenna/resonator may closely couple to the metal watch body to create resonant modes, as will be set forth in greater detail.

During use, the various watches of the foregoing embodiments may exhibit improved radiation of cellular signals via the associated helical antenna. More information will now be set forth regarding various signal characteristics that may be exhibited by different embodiments.

Figure 10:
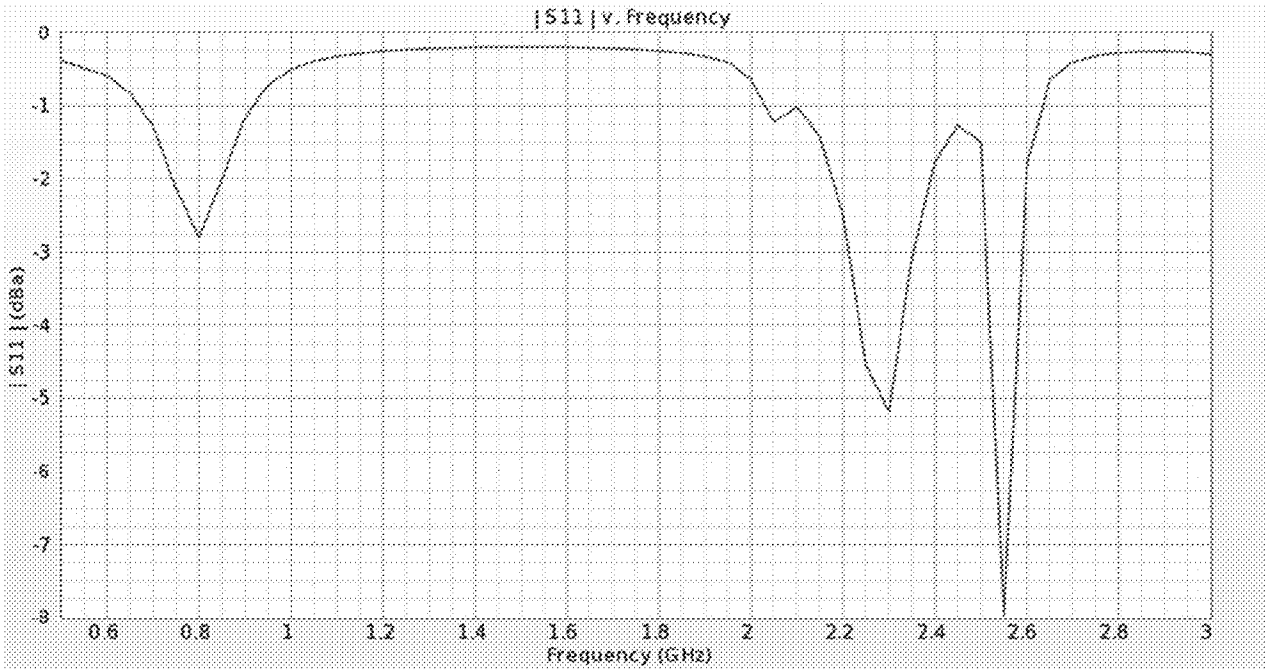
FIG. 10 shows a signal diagram illustrating, in free space, antenna matching/return loss, in accordance with one embodiment.
Figure 11:
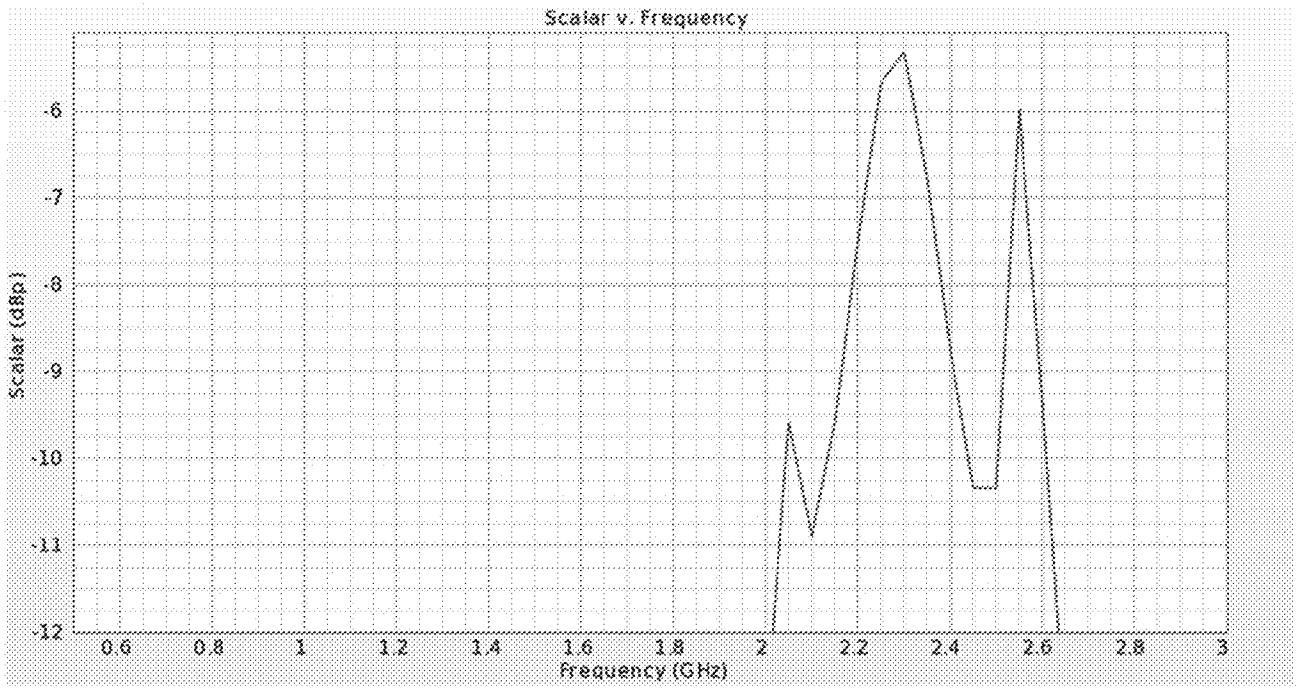
FIG. 11 shows a signal diagram illustrating, in free space, antenna efficiency, in accordance with one embodiment.
Figure 12:
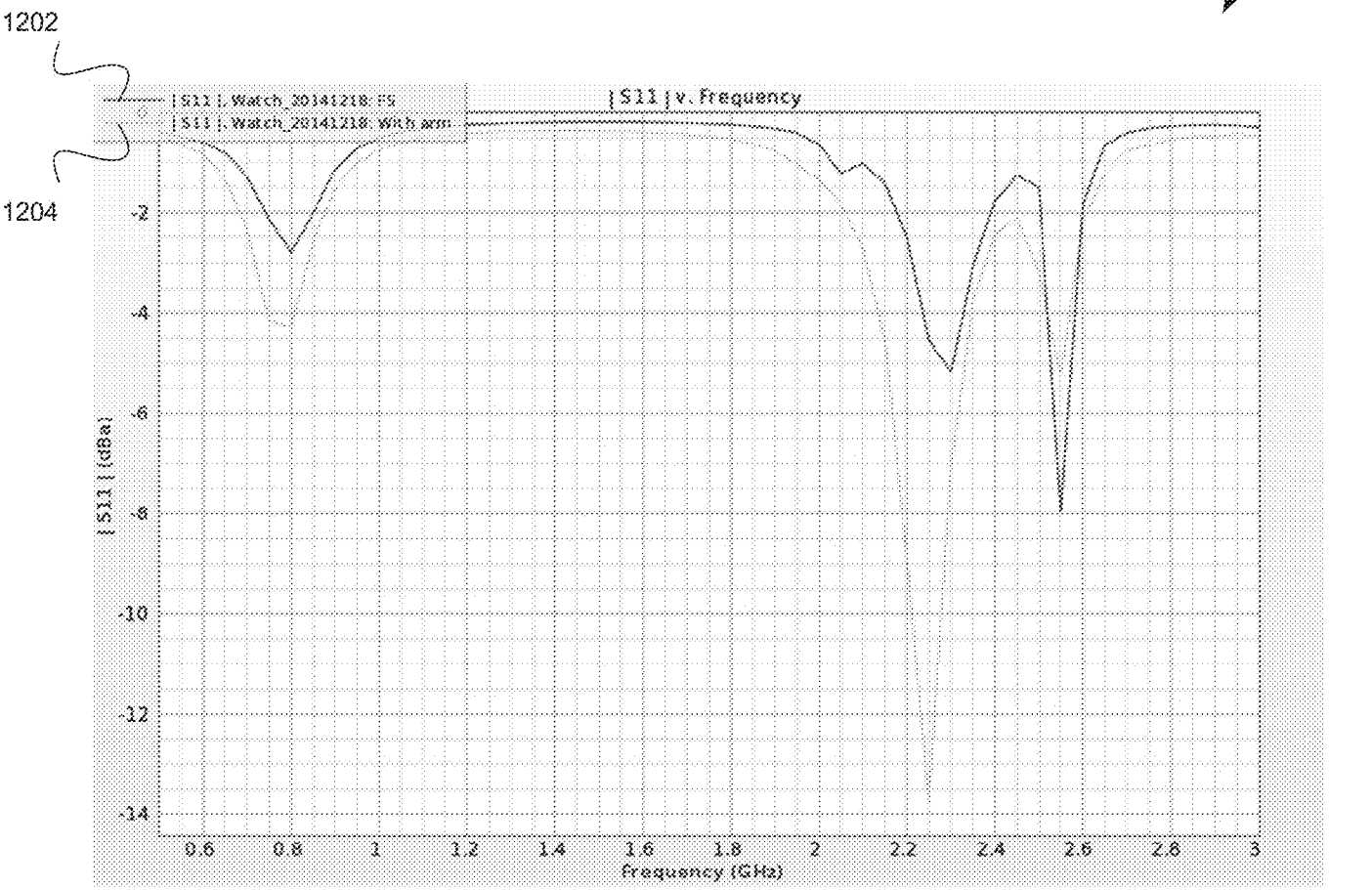
FIG. 12 shows a signal diagram illustrating antenna matching/return loss in free space versus when worn on a wrist, in accordance with one embodiment.

For example, FIG. 10 shows a signal diagram illustrating, in free space, antenna matching/return loss 1000, in accordance with one embodiment. Further, FIG. 11 shows a signal diagram illustrating, in free space, antenna efficiency 1100, in accordance with one embodiment. Still yet, FIG. 12 shows a signal diagram illustrating antenna matching/return loss 1200 in free space versus when worn, in accordance with one embodiment. Specifically, as shown, a first signal 1202 shows the antenna matching/return loss 1200 in free space (i.e. not worn), and a second signal 1204 shows the antenna matching/return loss 1200 when the watch is worn.

Figure 13:
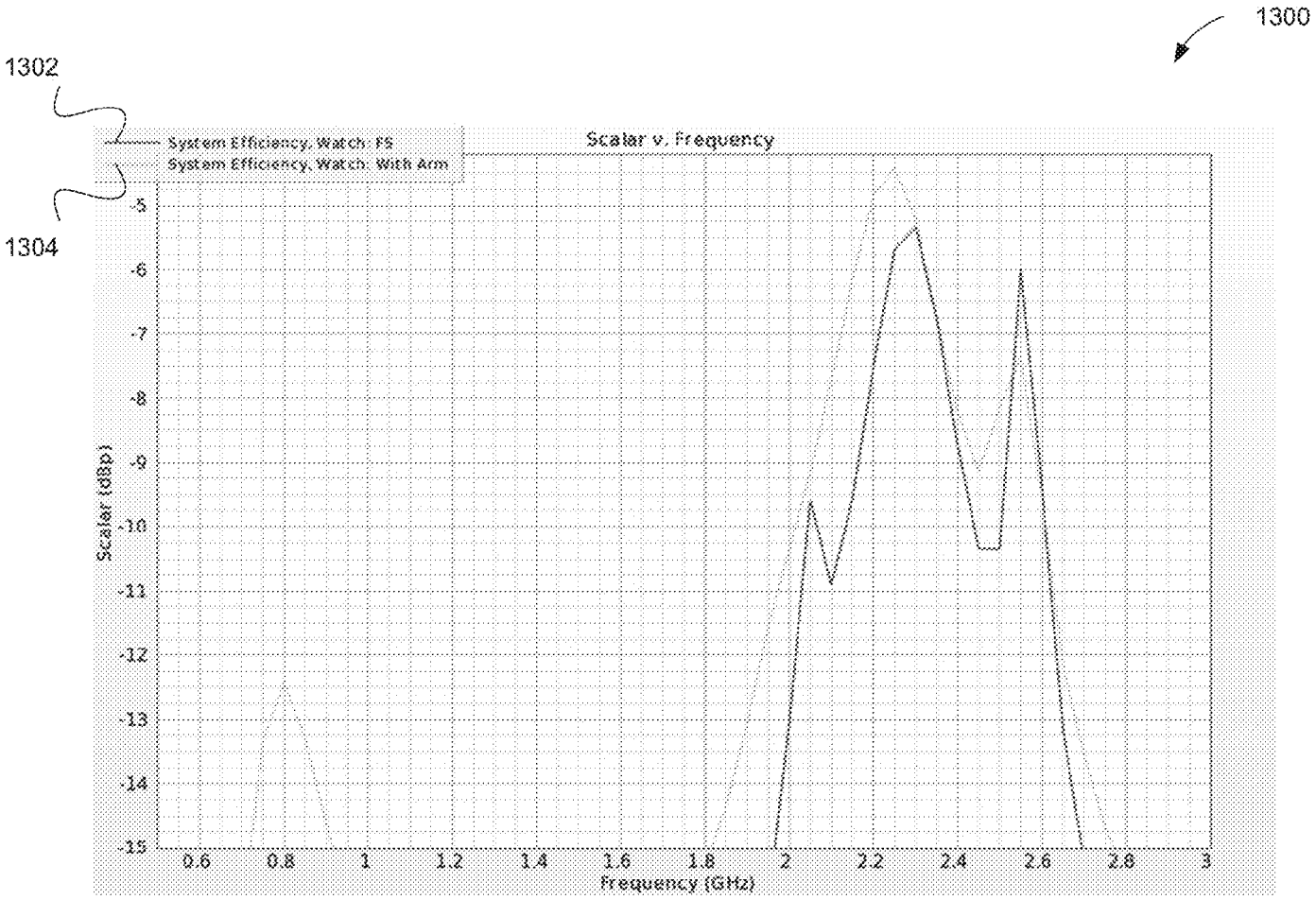
FIG. 13 shows a signal diagram illustrating antenna efficiency in free space versus when worn on a wrist, in accordance with one embodiment.

FIG. 13 shows a signal diagram illustrating antenna efficiency 1300 in free space versus when worn, in accordance with one embodiment. Specifically, as shown, a first signal 1302 shows the antenna efficiency 1300 in free space (i.e. not worn), and a second signal 1304 shows the antenna efficiency 1300 when the watch is worn.

Figure 14A:
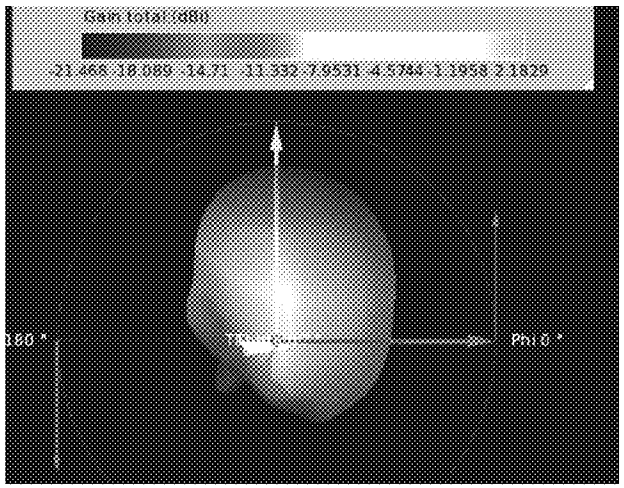
FIG. 14A includes a signal diagram illustrating, for a watch on a wrist, antenna radiation patterns, in accordance with one embodiment.
Figure 14B:
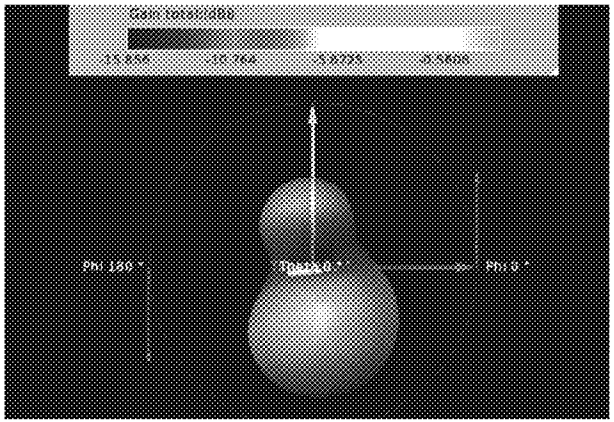
FIG. 14B includes a signal diagram illustrating, for free space, antenna radiation patterns, in accordance with one embodiment.

FIGS. 14A-14B include signal diagrams illustrating, for both free space and when the watch is worn, antenna radiation patterns 1400, in accordance with various embodiments. Specifically, FIG. 14A includes a signal diagram illustrating, for a watch placed on a wrist, antenna radiation patterns 1402, in accordance with one embodiment. Further, FIG. 14B includes a signal diagram illustrating, for free space, antenna radiation patterns 1404, in accordance with one embodiment.

Figure 15:
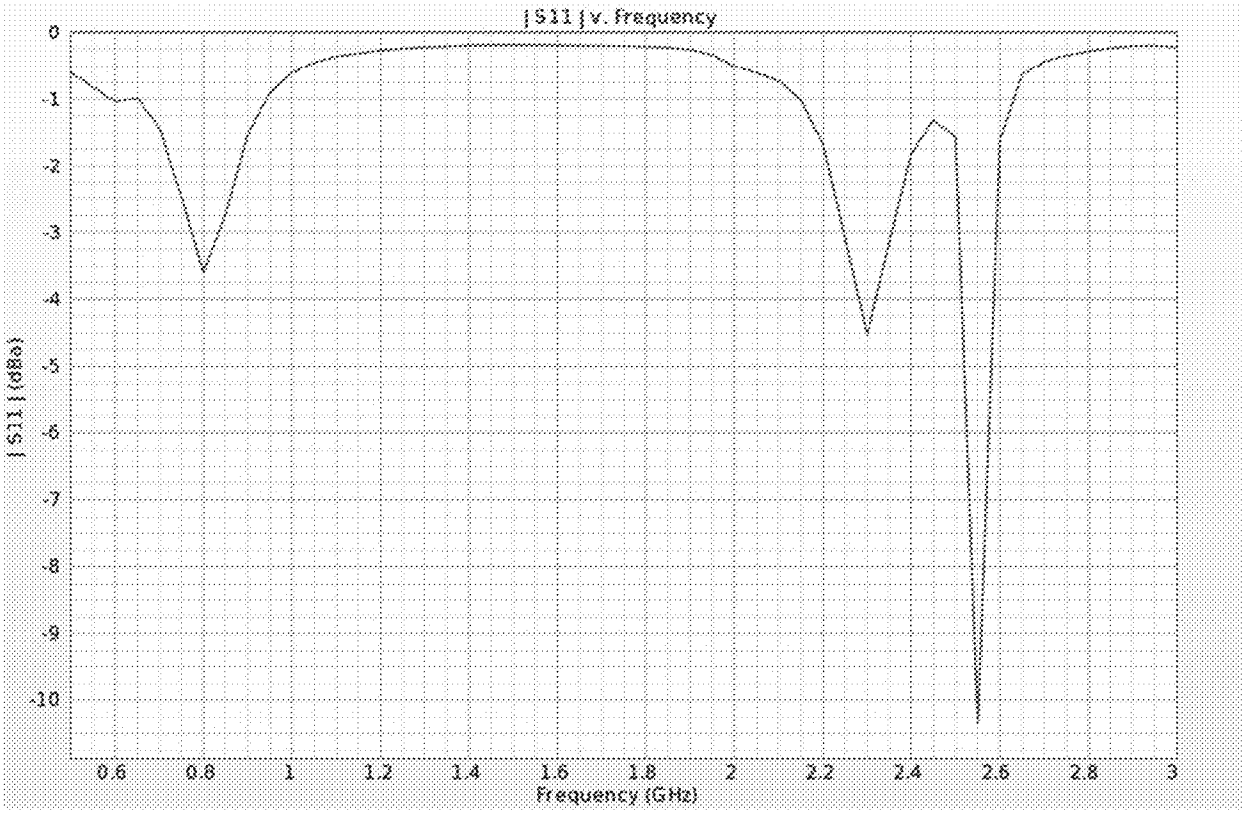
FIG. 15 shows a signal diagram illustrating, for free space, an antenna matching/return loss, in accordance with one embodiment incorporating metal wrist bands.
Figure 16:
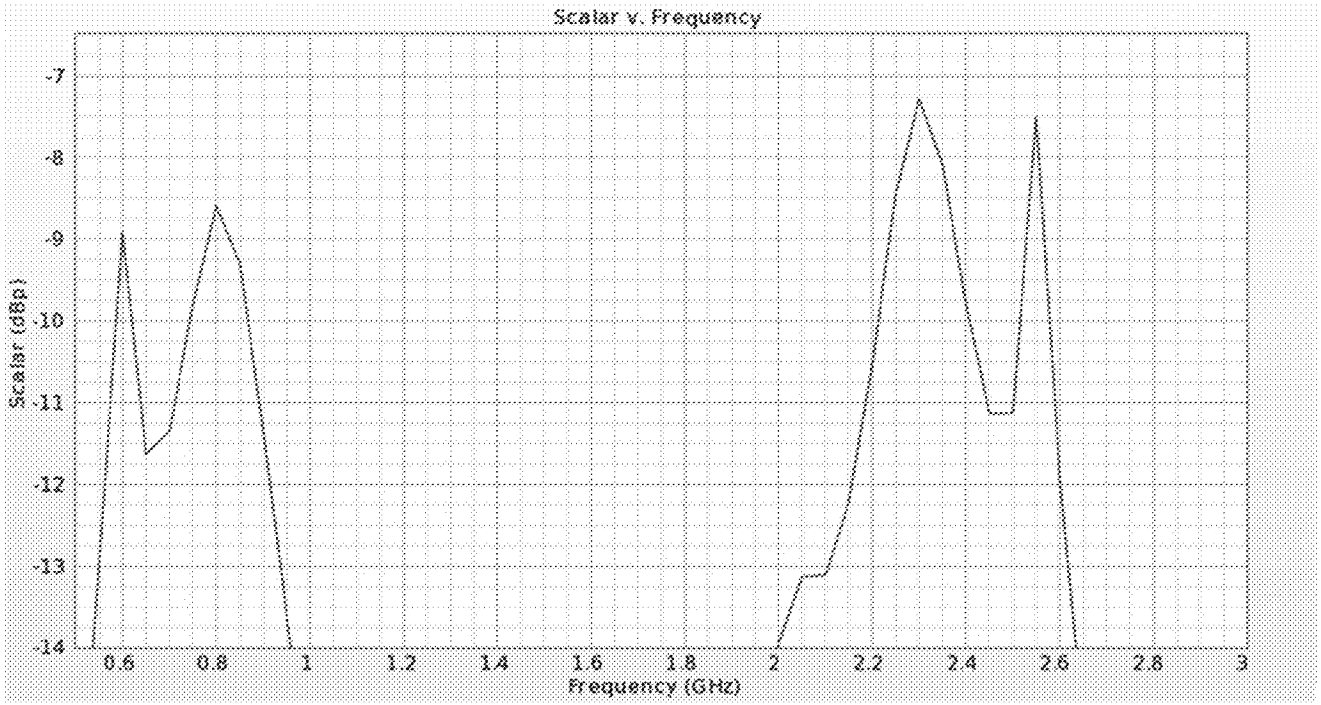
FIG. 16 shows a signal diagram illustrating, for free space, an antenna efficiency, in accordance with one embodiment incorporating metal wrist bands.

FIGS. 15-16 include signal diagrams illustrating, for free space, an antenna matching/return loss and antenna efficiency, in accordance with various embodiments incorporating metal wrist bands (e.g. wrist bands 702, 704 of FIGS. 7-8, etc.). Specifically, FIG. 15 shows a signal diagram illustrating, for free space, an antenna matching/return loss 1500, in accordance with one embodiment incorporating metal wrist bands. Further, FIG. 16 shows a signal diagram illustrating, for free space, an antenna efficiency 1600, in accordance with one embodiment incorporating metal wrist bands.

Thus, in accordance with various embodiments, cellular (e.g. 2G/3G/4G, etc.) operation may be afforded and an increased number of frequency bands may be achieved, while eliminating dependency on a cellular device (e.g. handset, tablet, etc.). Further, depending on the design features adopted from various embodiments, insulation techniques and some distance between the antenna and human body, may allow for lower specific absorption rate (SAR) values, thus affording increased safety.

Figure 17:
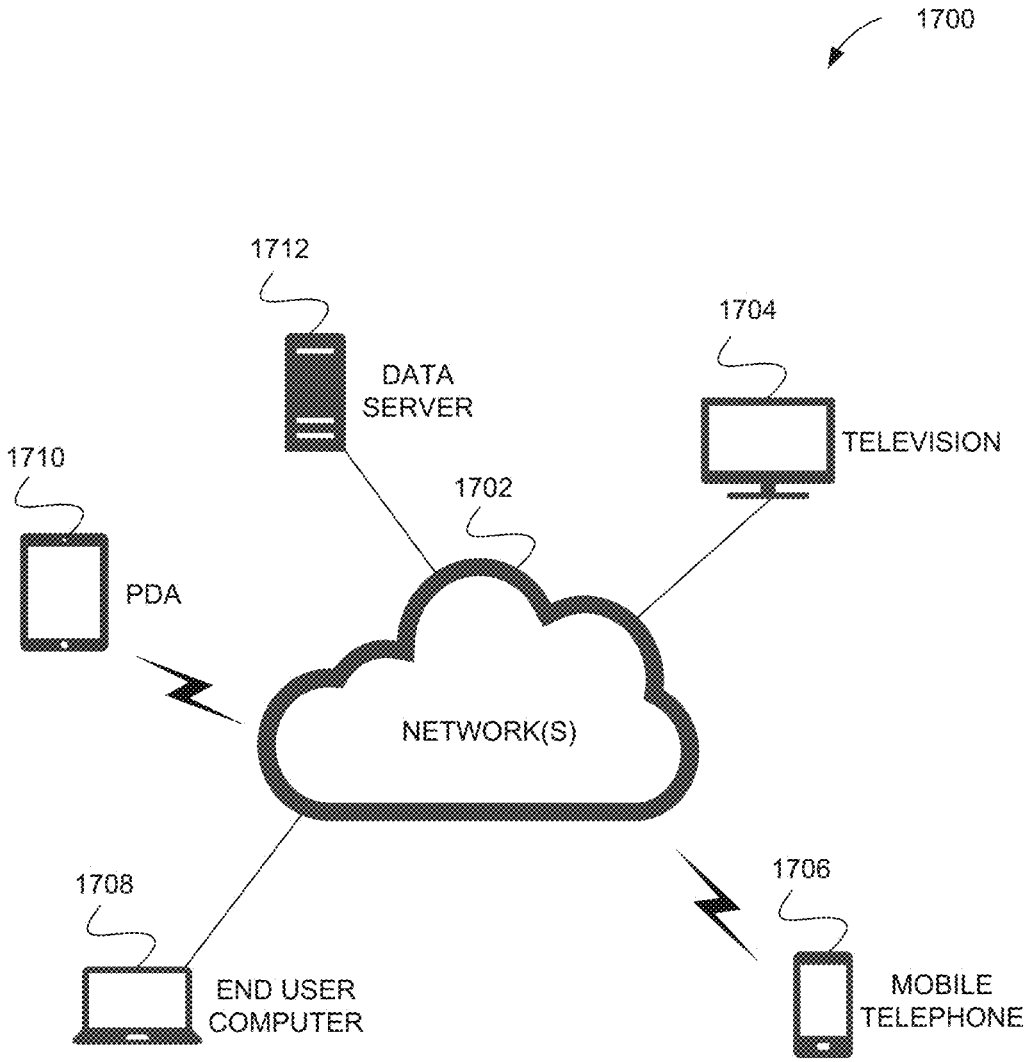
FIG. 17 illustrates a network architecture, in accordance with one possible embodiment.

FIG. 17 illustrates a network architecture 1700, in accordance with one possible embodiment. For example, in one embodiment, the watch from one or more of the previous embodiments may be implemented in the context of the current network architecture 1700.

As shown, at least one network 1702 is provided. In the context of the present network architecture 1700, the network 1702 may take any form including, but not limited to a telecommunications network, a local area network (LAN), a wireless network, a wide area network (WAN) such as the Internet, peer-to-peer network, cable network, etc. While only one network is shown, it should be understood that two or more similar or different networks 1702 may be provided.

Coupled to the network 1702 is a plurality of devices. For example, a server computer 1712 and an end user computer 1708 may be coupled to the network 1702 for communication purposes. Such end user computer 1708 may include a desktop computer, lap-top computer, and/or any other type of logic. Still yet, various other devices may be coupled to the network 1702 including a personal digital assistant (PDA) device 1710, a mobile phone device 1706, a television 1704, etc.

Figure 18:
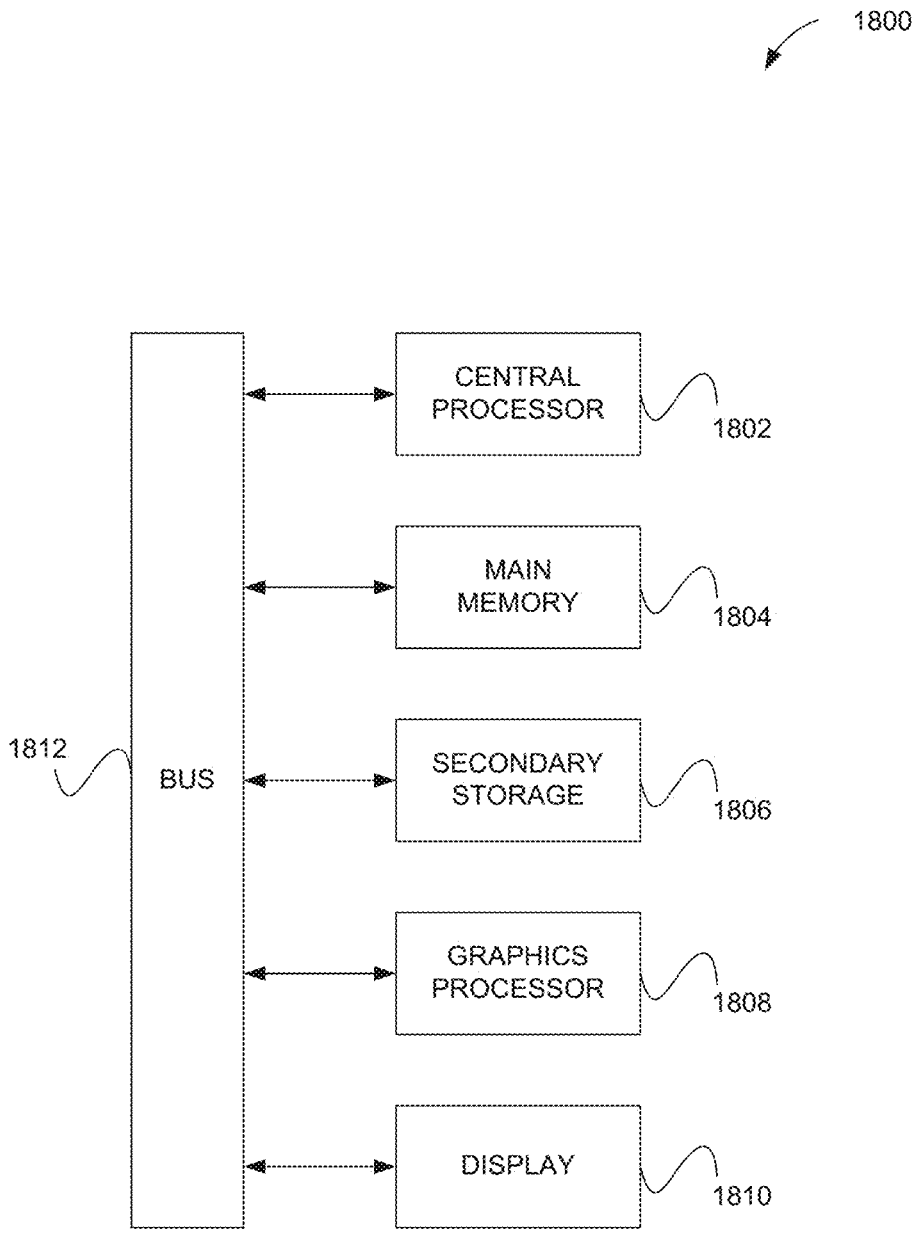
FIG. 18 illustrates an exemplary system, in accordance with one embodiment.

FIG. 18 illustrates an exemplary system 1800, in accordance with one embodiment. As an option, the system 1800 may be implemented in the context of any of the devices of the network architecture 1700 of FIG. 17, including a watch disclosed in one or more of the embodiments described hereinabove. Just by way of example, the apparatus 100 of FIG. 1 and/or the watch 200 of FIG. 2 may be equipped with one or more of the components of the system 1800. Of course, the system 1800 may be implemented in any desired environment.

As shown, a system 1800 is provided including at least one central processor 1802 which is connected to a communication bus 1812. The system 1800 also includes main memory 1804 [e.g. random access memory (RAM), etc.]. The system 1800 also includes a graphics processor 1808 and a display 1810.

The system 1800 may also include a secondary storage 1806. The secondary storage 1806 includes, for example, a hard disk drive and/or a removable storage drive, representing a floppy disk drive, a magnetic tape drive, a compact disk drive, etc. The removable storage drive reads from and/or writes to a removable storage unit in a well known manner.

Computer programs, or computer control logic algorithms, may be stored in the main memory 1804, the secondary storage 1806, and/or any other memory, for that matter. Such computer programs, when executed, enable the system 1800 to perform various functions (as set forth above, for example). Memory 1804, storage 1806 and/or any other storage are possible examples of tangible computer-readable media.

It is noted that the techniques described herein, in an aspect, are embodied in executable instructions stored in a computer readable medium for use by or in connection with an instruction execution machine, apparatus, or device, such as a computer-based or processor-containing machine, apparatus, or device. It will be appreciated by those skilled in the art that for some embodiments, other types of computer readable media are included which may store data that is accessible by a computer, such as magnetic cassettes, flash memory cards, digital video disks, Bernoulli cartridges, random access memory (RAM), read-only memory (ROM), and the like.

As used here, a "computer-readable medium" includes one or more of any suitable media for storing the executable instructions of a computer program such that the instruction execution machine, system, apparatus, or device may read (or fetch) the instructions from the computer readable medium and execute the instructions for carrying out the described methods. Suitable storage formats include one or more of an electronic, magnetic, optical, and electromagnetic format. A non-exhaustive list of conventional exemplary computer readable medium includes: a portable computer diskette; a RAM; a ROM; an erasable programmable read only memory (EPROM or flash memory); optical storage devices, including a portable compact disc (CD), a portable digital video disc (DVD), a high definition DVD (HD-DVD™), a BLU-RAY disc; and the like.

It should be understood that the arrangement of components illustrated in the Figures described are exemplary and that other arrangements are possible. It should also be understood that the various system components (and means) defined by the claims, described below, and illustrated in the various block diagrams represent logical components in some systems configured according to the subject matter disclosed herein.

For example, one or more of these system components (and means) may be realized, in whole or in part, by at least some of the components illustrated in the arrangements illustrated in the described Figures. In addition, while at least one of these components are implemented at least partially as an electronic hardware component, and therefore constitutes a machine, the other components may be implemented in software that when included in an execution environment constitutes a machine, hardware, or a combination of software and hardware.

More particularly, at least one component of one or more embodiments may be implemented at least partially as an electronic hardware component, such as an instruction execution machine (e.g., a processor-based or processor-containing machine) and/or as specialized circuits or circuitry (e.g., discreet logic gates interconnected to perform a specialized function). Other components may be implemented in software, hardware, or a combination of software and hardware. Moreover, some or all of these other components may be combined, some may be omitted altogether, and additional components may be added while still achieving the functionality described herein. Thus, the subject matter described herein may be embodied in many different variations, and all such variations are contemplated to be within the scope of one or more embodiments.

In the description above, the subject matter is described with reference to acts and symbolic representations of operations that are performed by one or more devices, unless indicated otherwise. As such, it will be understood that such acts and operations, which are at times referred to as being computer-executed, include the manipulation by the processor of data in a structured form. This manipulation transforms the data or maintains it at locations in the memory system of the computer, which reconfigures or otherwise alters the operation of the device in a manner well understood by those skilled in the art. The data is maintained at physical locations of the memory as data structures that have particular properties defined by the format of the data. However, while the subject matter is being described in the foregoing context, it is not meant to be limiting as those of skill in the art will appreciate that various of the acts and operations described hereinafter may also be implemented in hardware.

To facilitate an understanding of the subject matter described herein, many aspects are described in terms of sequences of actions. At least one of these aspects defined by the claims is performed by an electronic hardware component. For example, it will be recognized that the various actions may be performed by specialized circuits or circuitry, by program instructions being executed by one or more processors, or by a combination of both. The description herein of any sequence of actions is not intended to imply that the specific order described for performing that sequence must be followed. All methods described herein may be performed in any suitable order unless otherwise indicated herein or otherwise clearly contradicted by context The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

The embodiments described herein included the one or more modes known to the inventor for carrying out the claimed subject matter. Of course, variations of those embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

What is claimed is:

1. An apparatus, comprising:

a housing of a wearable article that houses a device including circuitry;

a pusher moveably coupled to the housing and operable to generate a signal in response to a movement thereof, the signal controlling at least one functional aspect provided via the circuitry of the device; and a helical antenna residing at least partially within the pusher and in communication with the circuitry for communicating radio frequency (RF) signals in association with the circuitry;

wherein an end of the helical antenna extends beyond a periphery of the housing.

2. The apparatus of claim 1, wherein the apparatus is configured such that the signal is generated in response to a depression of the pusher.

3. The apparatus of claim 2, wherein the helical antenna is configured to be springably-biased in response to the depression of the pusher so as to extend the pusher after the depression of the pusher.

4. The apparatus of claim 1, wherein the pusher is constructed from a conductive material.

5. The apparatus of claim 4, wherein the pusher is constructed from the conductive material such that the pusher remains RF capable in connection with the communication of the RF signals from the helical antenna.

6. The apparatus of claim 1, wherein an outer surface of the pusher is lined with at least one material that is insulative, but has a metallic appearance.

7. The apparatus of claim 6, wherein the at least one material with the metallic appearance compliments an appearance of the housing.

8. The apparatus of claim 1, and further comprising a wrist band.

9. The apparatus of claim 8, wherein the wrist band is constructed from a conductive material that is in electrical communication with a printed circuit board positioned in the housing, the housing configured for providing a ground plane in connection with the helical antenna.

10. The apparatus of claim 9, wherein the wrist band extends a reference ground plane to enhance performance in connection with the communication of the RF signals from the helical antenna.

11. The apparatus of claim 1, wherein the housing includes a back plate configured for abutting a skin of a user.

12. The apparatus of claim 11, wherein the back plate of the housing is constructed from an insulative material.

13. The apparatus of claim 11, wherein the housing is configured with an insulative region between the back plate and a transceiver positioned in the housing.

14. The apparatus of claim 1, wherein the helical antenna is configured for communicating multi-band-multi-mode RF signals.

15. The apparatus of claim 1, wherein the helical antenna is configured for communicating cellular RF signals.

16. The apparatus of claim 1, and further comprising:

another component coupled to the housing; and another helical antenna coupled to the another component.

17. The apparatus of claim 1, wherein the apparatus includes a watch.

18. The apparatus of claim 1, wherein the end of the helical antenna extends beyond the periphery of the housing for enhancing the communication of the RF signals from the helical antenna.

19. The apparatus of claim 1, wherein the pusher is rotatably coupled to a housing of the wearable article, and wherein the pusher is operable to generate the signal in response to the winding thereof.

20. The apparatus of claim 1, wherein the pusher is lined with at least one material applied through a non-conductive vacuum metallization (NCVM) process such that an external cap of the pusher is designed to help remain RF transparent.

21. The apparatus of claim 1, wherein the helical antenna is coupled to a transceiver via first electrical connections, and is in communication with the circuitry via the transceiver for receiving at least a first portion of the RF signals that are generated by the circuitry, and wherein the circuitry is controlled by way of second electrical connections connected to a switch that is closed or opened in response to the movement of the pusher.

22. A method, comprising:

receiving a signal in response to manipulation of a pusher moveably coupled to a housing of a wearable article, wherein the housing houses a device including circuitry and wherein the signal controls at least one functional aspect provided via the circuitry of the device; and communicating radio frequency (RF) signals in association with the circuitry, utilizing a helical antenna residing at least partially within the pusher and in communication with the circuitry;

wherein an end of the helical antenna extends beyond a periphery of the housing.

* * * * *